US006492605B2

(12) United States Patent
Iida

(10) Patent No.: US 6,492,605 B2
(45) Date of Patent: Dec. 10, 2002

(54) SWITCH OPERATING DEVICE

(75) Inventor: Toshiyasu Iida, Tokorozawa (JP)

(73) Assignee: Pioneer Corporation, Tokyo-To (JP)

( * ) Notice: Subject to any disclaimer, the term of this patent is extended or adjusted under 35 U.S.C. 154(b) by 0 days.

(21) Appl. No.: 10/017,292

(22) Filed: Dec. 18, 2001

(65) Prior Publication Data

US 2002/0092749 A1 Jul. 18, 2002

(30) Foreign Application Priority Data

Dec. 19, 2000 (JP) ..... 2000-385269

(51) Int. Cl.[7] ..... H01H 13/70
(52) U.S. Cl. ..... 200/343; 200/5 A
(58) Field of Search ..... 200/5 A, 5, 7, 200/341–345, 296, 517

(56) References Cited

U.S. PATENT DOCUMENTS 4,315,114 A * 2/1982 Monti, Jr. ..... 200/343
4,877,925 A * 10/1989 Kobayashi ..... 200/343
5,481,074 A * 1/1996 English ..... 200/341

* cited by examiner

*Primary Examiner*—Elvin Enad
*Assistant Examiner*—M. Fishman
(74) *Attorney, Agent, or Firm*—Young & Thompson

(57) ABSTRACT

A switch operating device (50) is provided with: a mounting frame (4); a plurality of operating keys (10) each having a pressing portion (1) to be operated; a hinge portion (2) for elastically supporting each of the operating keys to the mounting frame; and a connecting portion (3), which is adapted to be elastically deformed and which is formed between the mounting frame and a vicinity of the pressing portion of each of the operating keys, for preventing an adjacent operating key or keys among the operating keys from moving slightly in response to an operation of one operating key among the operating keys which is adjacent to the adjacent operating key or keys.

7 Claims, 4 Drawing Sheets

SWITCH OPERATING DEVICE

BACKGROUND OF THE INVENTION

1. Field of the Invention

The present invention relates to a structure of a switch operating device for an electronic equipment.

2. Description of the Related Art

With reference to various types of electronic equipments such as a CD (Compact Disc) player, a DVD player and the like, there is used a switch operating device which is made of a synthetic resin and in which each of a plurality of operating keys is elastically supported to a mounting frame by respective one of hinge portions.

However, according to the switch operating device described above, since the plurality of operating keys are integrally formed of the synthetic resin, deformation caused by an operation of one operating key is transmitted to the other adjacent operating key or keys through the hinge portion or portions, resulting in an unintentional or unwilling slight movement of the adjacent operating key or keys.

SUMMARY OF THE INVENTION

It is therefore an object of the present invention to provide a switch operating device, which can prevent the adjacent operating key or keys, adjacent to one operating key of the switch operating device, from moving slightly even if the one operating key is operated.

The above object of the present invention can be achieved by a switch operating device provided with: a mounting frame; a plurality of operating keys each having a pressing portion to be operated; a hinge portion for elastically supporting each of the operating keys to the mounting frame; and a connecting portion, which is adapted to be elastically deformed and which is formed between the mounting frame and a vicinity of the pressing portion of each of the operating keys, for preventing an adjacent operating key or keys among the operating keys from moving slightly in response to an operation of one operating key among the operating keys which is adjacent to the adjacent operating key or keys.

According to the switch operating device of the present invention, even if one operating key is operated, it is possible to prevent the adjacent operating key or keys from moving slightly. Moreover, because of that, the degree of freedom for designing the switch operating device may be certainly increased.

In one aspect of the present invention, the switch operating device is made of an elastic material.

According to this aspect, the switch operating device is subjected to be deformed when any one of the operating keys is pressed. However, it is still possible to prevent the adjacent operating key or keys from moving slightly.

In this aspect, the elastic material may comprise a synthetic resin.

In another aspect of the present invention, the connecting portion is wire-shaped and is curved like a letter U.

According to this aspect, the deformation caused by the operation of one operating key can be effectively prevented from being transmitted to the adjacent operating key or keys.

In another aspect of the present invention, each of the operating keys inclines with the hinge portion as a fulcrum when the pressing portion is operated, to thereby make a switch driving portion of the switch operating device press a switch, which is mounted on a substrate disposed on a backside surface of the switch operating device.

According to this aspect, the switch operating device can convert the pressing operation by the each operating key to ON-OFF operation for an electric signal at the switch.

In this aspect, the switch operating device may be further provided with a reinforcing plate for reinforcing a relative orientation between the pressing portion and the switch driving portion.

By constituting in this manner, for example, relative orientation between the pressing portion and the switch driving portion can be surely maintained. For example, the pressing portion and the switch driving portion can be surely held substantially vertically.

The nature, utility, and further features of this invention will be more clearly apparent from the following detailed description with respect to a preferred embodiment of the invention when read in conjunction with the accompanying drawings briefly described below.

DETAILED DESCRIPTION OF THE PREFERRED EMBODIMENT

Figure 1A:
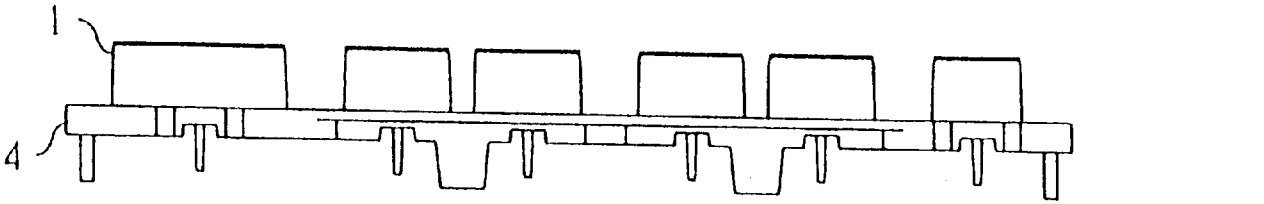
FIG. 1A is a plan view showing the upper surface of a switch operating device of an embodiment of the present invention.

Referring to the accompanying drawings, the embodiment of the present invention will be now explained with reference to FIG. 1.

A switch operating device 50 of the present embodiment is constructed as follows. Namely, each one of a plurality of operating keys 10 is shaped into a schematic rectangular, has a pressing portion 1 to be operated, and is integrally formed with a mounting frame 4 of a resin through a hinge portion 2 and a connecting portion 3. Each operating key 10 is provided with the pressing portion 1 which is on the upper surface side of the switch operating device 50 (refer to FIG. 1B) and which is formed to project in the direction of the front surface of the switch operating device 50 (refer to FIG. 1A and FIG. 1B). Each operating key 10 is also provided with a switch driving portion 6 which is on the bottom surface side of the switch operating device 50 (refer to FIG. 1B) and which is formed to project vertically together with a reinforcing plate 5 in the direction of the backside surface of the switch operating device 50 (refer to FIG. 1A and FIG. 1B). The purpose of the reinforcing plate 5 is to hold the pressing portion 1 and the switch driving portion 6 substantially vertically.

Figure 1C:
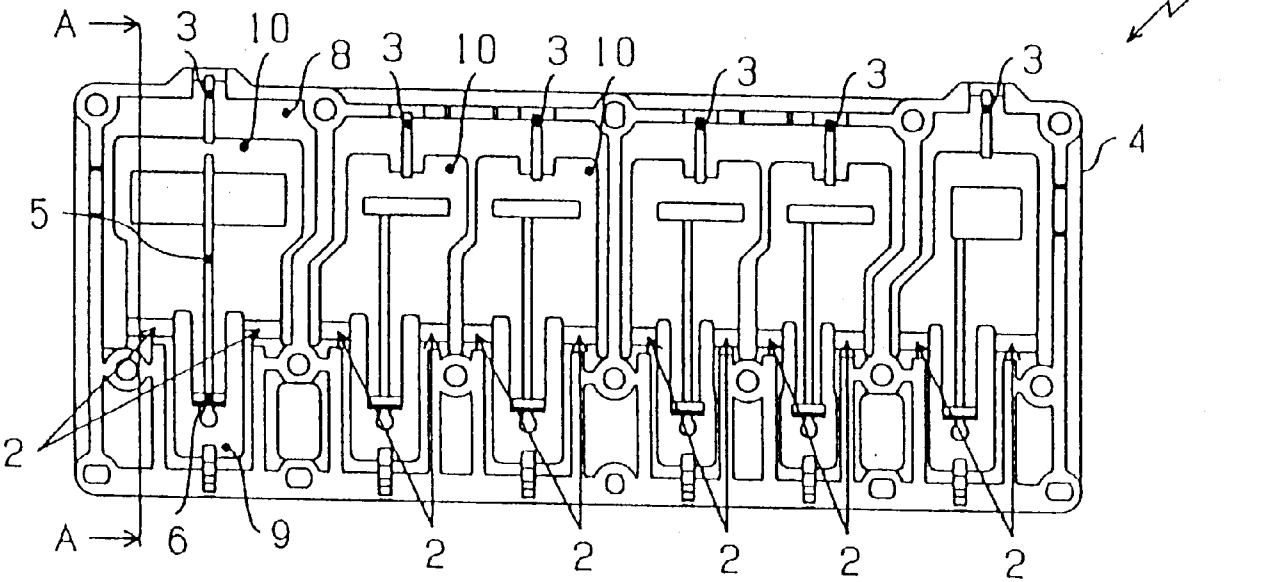
FIG. 1C is a back elevation view showing the backside surface of the switch operating device of the embodiment.
Figure 1B:
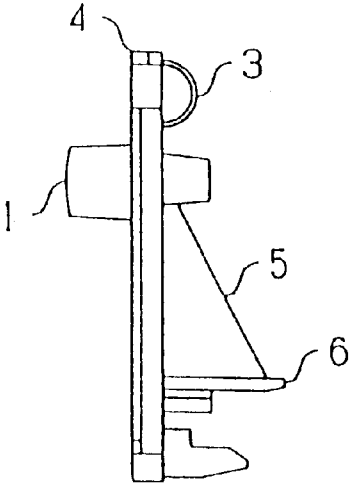
FIG. 1B is a side view showing the switch operating device of the embodiment.
Figure 4:
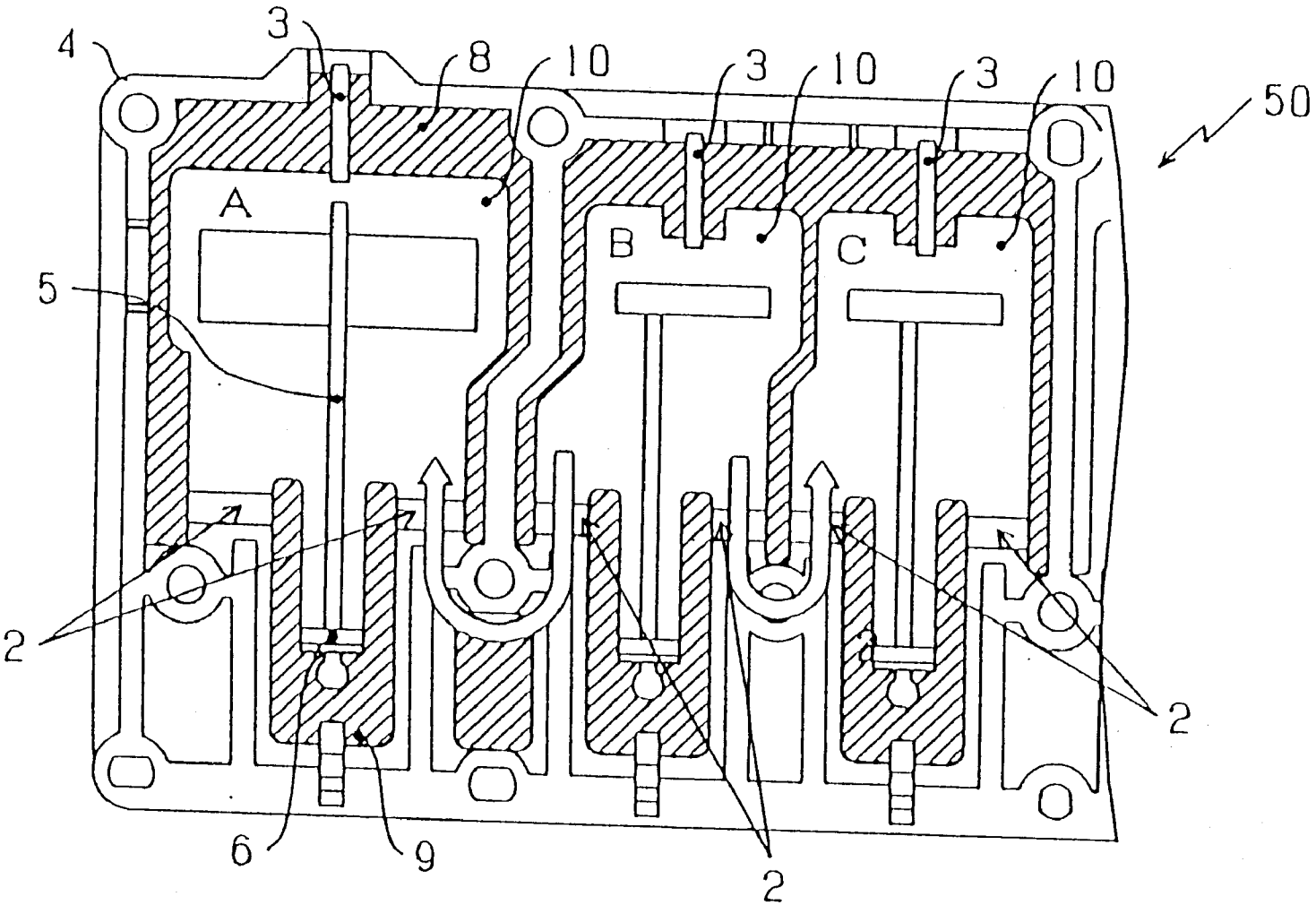
FIG. 4 is a partial enlarged back elevation view of the backside surface of the switch operating device of the embodiment.

With reference to the switch operating device 50, there are formed an inverted U-shaped opening portion 8 around the pressing portion 1 of each operating key 10 and a U-shaped opening portion 9 around the switch driving portion 6 (refer to FIG. 1C and FIG. 4). The region where the inverted U-shaped opening portion 8 and the U-shaped opening portion 9 are overlapped to each other is formed thin in its thickness, and a hinge portion 2 of the operating key 10 is formed in the region. The hinge portion 2 is positioned on the substantial center of the pressing portion 1 and the switch driving portion 6. When the pressing portion 1 is operated, the operating key 10 is rotated around the hinge portion 2 as a substantial rotation axis. Moreover, with reference to the switch operating device 50, there is formed a wire-shaped connecting portion 3 curved like a letter U between the mounting frame 4 and the upper central portion of each operating key 10, i.e. in the vicinity of the pressing portion 1.

Figure 2:
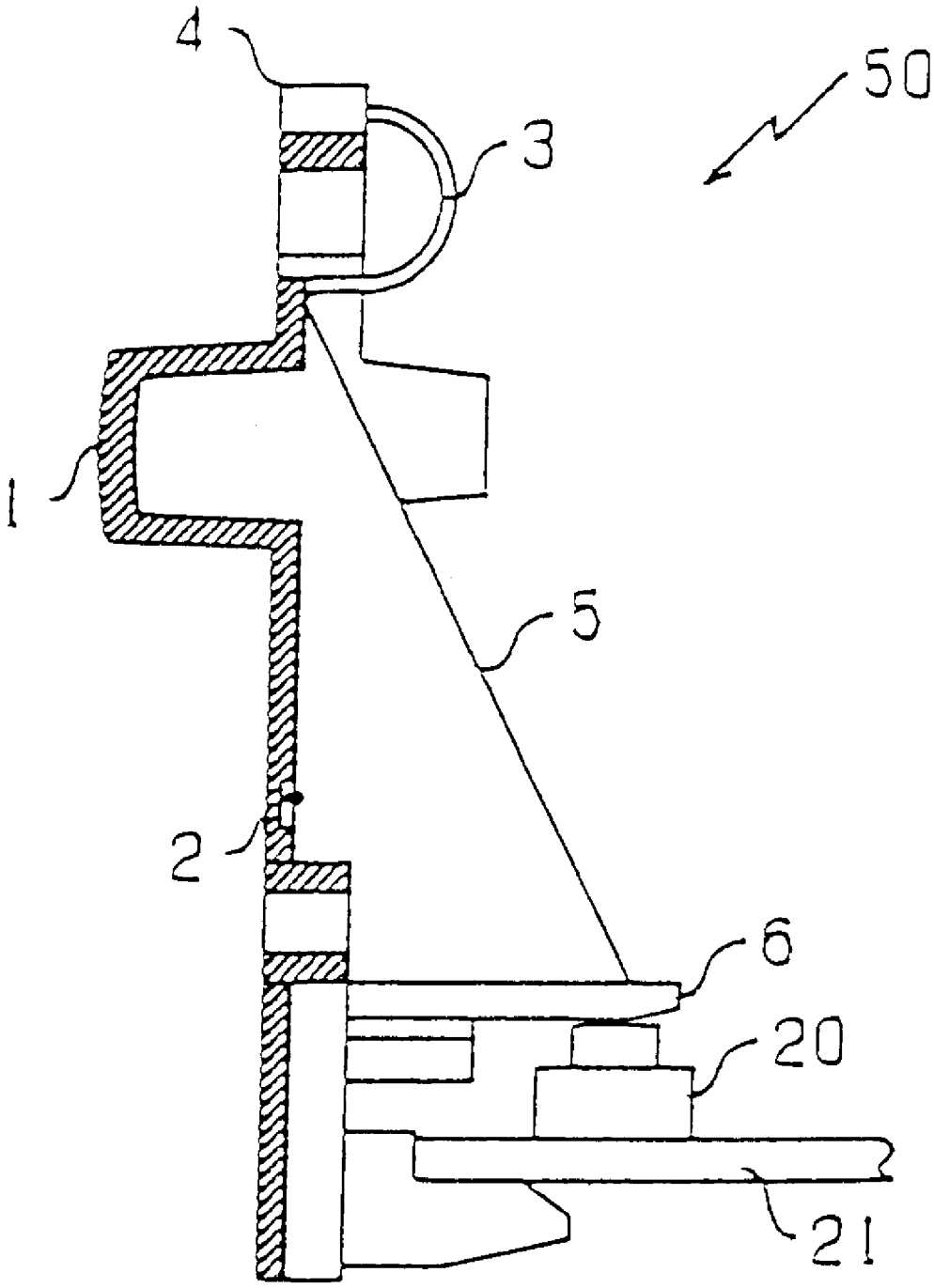
FIG. 2 is an A—A cross sectional view of FIG. 1C showing the switch operating device of the embodiment in one condition.
Figure 3:
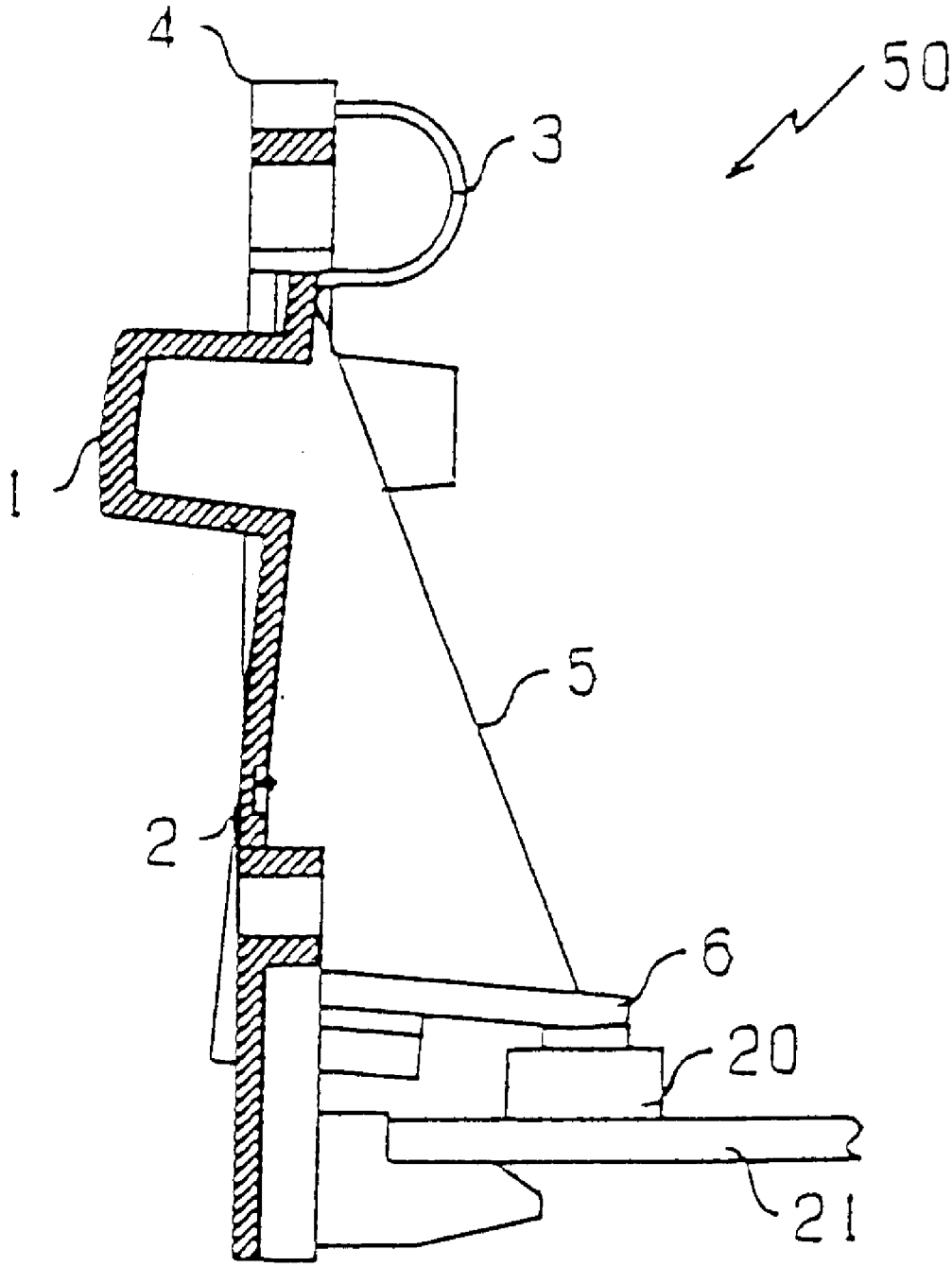
FIG. 3 is an A—A cross sectional view of FIG. 1C showing the switch operating device of the embodiment in another condition.

The switch operating device 50 of the present embodiment is used in such a status that a substrate 21, on which a plurality of switches 20 are mounted, is attached to the backside thereof. These structures will be explained with reference to FIG. 2 and FIG. 3. FIG. 2 is an A—A cross sectional view of FIG. 1C showing the switch operating device 50 in an ordinary condition. FIG. 3 is an A—A cross sectional view of FIG. 1C showing the switch operating device 50 in a press condition.

The switch operating device 50 is used in such a status that the substrate 21, on which a plurality of switches 20 are mounted, is attached to a predetermined position on the backside thereof (at the position where each switch driving portion 6 abuts onto the respective one of the switches 20). As shown in FIG. 3., when the pressing portion 1 is pressed, in the operating key 10, the switch driving portion 6 is rotated around the hinge portion 2 as a substantial rotation axis, so that the switch driving portion 6 moves down and presses the switch 20. In this manner, the switch operating device 50 converts the pressing operation by the each operating key 10 to an ON-OFF operation for an electric signal.

With reference to the switch operating device 50 of the present embodiment, the adjacent operating keys 10 are prevented from moving slightly by providing the connecting portion 3 for the switch operating device 50. The connecting portion 3's effect and pressing operation will be explained with reference to FIG. 4. Incidentally, FIG. 4 is a partial enlarged back elevation view of the backside of the switch operating device 50, and a portion which is not a resin member (i.e., a groove portion) is shown with hatching so as to understand the structure of the switch operating device 50 easily.

With reference to the switch operating device 50 as described above, when the pressing portion 1 of the operating key 10 is pressed, the operating key 10 inclines in the direction of the backside of the switch operating device 50 with the hinge portion 2 as the fulcrum, so that the switch driving portion 6 inclines in cooperation with this movement to thereby press down the switch 20 (refer to FIG. 3). Because the hinge portions 2 of the operating key 10 are placed adjacent to each other on the switch operating device 50, if the pressing portion 1 of the "B" operating key 10 (i.e., the operating key 10 shown with a letter "B" in FIG. 4) is pressed, for example, there is a possibility that the deformation caused by the operation of the "B" operating key 10 is transmitted to the hinge portion 2 on the left of the "B" operating key 10, to the mounting frame 4, to the hinge portion 2 on the right of an "A" operating key 10 (i.e., the operating key 10 shown with a letter "A" in FIG. 4), and finally to the "A" operating key 10 which is in vicinity of the left side of the "B" operating key 10. Accordingly, if no countermeasure against this transmission of the deformation to the "A" operating key 10 from the "B" operating key is employed, the adjacent operating key 10 (i.e., the "A" operating key 10) would slightly move. In the same way, this deformation caused by the operation of the "B" operating key 10 is transmitted finally to a "C" operating key 10 (i.e., the operating key 10 shown with a letter "C" in FIG. 4). Accordingly, if no countermeasure against this transmission of the deformation to the "C" operating key 10 from the "B" operating key 10 is employed, the adjacent operating key 10 (i.e., the "C" operating key 10) would slightly move. However, according to the switch operating device 50 with reference to the present embodiment, the adjacent operating keys 10 are hardly moved or not moved at all in a practical sense by the deformation caused through the hinge portions 2 because the upper central portion of each operating key 10 is elastically supported to the mounting frame 4 by the connecting portion 3.

As described above, with reference to the switch operating device of the present invention, it is possible to prevent the adjacent operating keys from moving slightly by providing each operating key with the connecting portion even if the switch operating device is constructed such that the hinge portions of a plurality of operating keys are arranged adjacent to each other. Moreover, because of that, the degree of freedom for design may be certainly increased.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2000-385269 filed on Dec. 19, 2000 including the specification, claims, drawings and summary is incorporated herein by reference in its entirety.

What is claimed is:

1. A switch operating device comprising:

a mounting frame;

a plurality of operating keys each having a pressing portion to be operated;

a hinge portion for elastically supporting each of said operating keys to said mounting frame; and a connecting portion, which is elastically deformable and which is formed between said mounting frame and a vicinity of the pressing portion of each of said operating keys, for preventing an adjacent operating key or keys among said operating keys from moving slightly in response to an operation of one operating key among said operating keys which is adjacent to said adjacent operating key or keys, said connecting portion being connected to one side of said operation key, said hinge portion being connected to another side of said operation key which is opposite to said one side.

2. The switch operating device according to claim 1, wherein at least said hinge portion and said connecting portion of said switch operating device are made of an elastic material.

3. The switch operating device according to claim 2, wherein said elastic material comprises a synthetic resin.

4. The switch operating device according to claim 1, wherein said connecting portion is wire-shaped and is curved like a letter U.

5. The switch operating device according to claim 1, wherein each of said operating keys inclines with said hinge portion as a fulcrum when the pressing portion is operated, to thereby make a switch driving portion of said switch operating device press a switch, which is mounted on a substrate disposed on a backside surface of said switch operating device.

6. The switch operating device according to claim 5, further comprising a reinforcing plate for reinforcing a relative orientation between the pressing portion and the switch driving portion.

7. The switch operating device according to claim 1, wherein each of said operating keys moves around a root of said hinge portion when being pressed.

* * * * *